US005137087A

United States Patent [19]

Szarka et al.

[11] Patent Number: 5,137,087

[45] Date of Patent: Aug. 11, 1992

[54] CASING CEMENTER WITH TORQUE-LIMITING ROTATING POSITIONING TOOL

[75] Inventors: David D. Szarka; Richard L. Giroux, both of Duncan, Okla.; Joseph B. Crump, Plains, Tex.

[73] Assignee: Halliburton Company, Duncan, Okla.

[21] Appl. No.: 741,859

[22] Filed: Aug. 7, 1991

[51] Int. Cl.[5] ..... E21B 33/13

[52] U.S. Cl. ..... 166/289; 166/117.7; 166/154; 166/194; 166/330

[58] Field of Search ..... 166/51, 124, 147, 151, 166/154, 186, 289, 332, 334, 367, 375, 355

[56] References Cited

U.S. PATENT DOCUMENTS

| | | | |
|---|---|---|---|
| 2,925,865 | 2/1960 | Oliver | 166/154 |
| 3,183,974 | 5/1965 | Baker | 166/141 |
| 3,223,160 | 12/1965 | Baker | 166/27 |
| 3,228,473 | 1/1966 | Baker | 166/154 |
| 3,247,905 | 4/1966 | Baker | 166/194 |
| 3,768,556 | 10/1973 | Baker | 166/154 |
| 3,768,562 | 10/1973 | Baker | 166/289 |
| 3,811,500 | 5/1974 | Morrisett et al. | 166/154 |
| 3,948,322 | 4/1976 | Baker | 166/289 |
| 4,105,069 | 8/1978 | Baker | 166/51 |
| 4,246,968 | 1/1981 | Jessup et al. | 166/334 |
| 4,286,658 | 9/1981 | Baker et al. | 166/186 |
| 4,319,638 | 3/1982 | Baker et al. | 166/355 |
| 4,334,582 | 6/1982 | Baker et al. | 166/355 |
| 4,421,165 | 12/1983 | Szarka | 166/151 |

OTHER PUBLICATIONS

"TAMCAP TM Inflatable Cementing Packers", pp. 6 and 7, published in 1986 by TAM International, Inc.

Halliburton Services Sales & Service Catalog No. 43 (1985), pp. 2440-2451.

*Primary Examiner*—Thuy M. Bui

*Assistant Examiner*—Frank S. Tsay

*Attorney, Agent, or Firm*—James R. Duzan; Neal R. Kennedy

[57] ABSTRACT

A casing cementer with torque-limiting rotating positioning tool. The casing cementer comprises a housing with a rotating valve sleeve therein. A positioning tool is used to rotated the valve sleeve between open and closed positions thereof. No reciprication of the positioning tool is required. The valve sleeve has a sealing ring molded thereto for sealing between the housing and the valve sleeve. The valve sleeve preferably has an inside diameter at least as large as an inside diameter of the casing. A stop is provided to limit movement of the valve sleeve when it reaches either the open or closed position. A clutch in the positioning tool provides for torque-limitation and a ratcheting indication to the operator at the surface when the valve sleeve has been opened or closed.

20 Claims, 3 Drawing Sheets

CASING CEMENTER WITH TORQUE-LIMITING ROTATING POSITIONING TOOL

BACKGROUND OF THE INVENTION

1. Field Of The Invention

This invention relates to casing cementers for use in oil and gas wells, and more particularly, to a casing cementer which is opened and closed by rotation of a positioning tool and includes a means for limiting torque applied thereto.

2. Description Of The Prior Art

Currently, most casing cementers used in operations for cementing well casing utilize reciprocating motion to open and close the cementer. Examples of such devices include the Halliburton FO Cementers which have a sliding sleeve therein and are generally disclosed in U.S. Pat. No. 3,768,562, assigned to the assignee of the present invention. Collet fingers on the cementer hold the tool closed (or open) until a positioning tool is inserted to actuate the sleeve in the cementer. The positioning tool uses fingers to latch into the cementer and open and close the sleeve by reciprocation. Similar devices include the Halliburton FO Packer Collar and Halliburton FO Frac Tool.

The FO Cementers have worked well, but occasionally difficulties occur with other tools used with them. Swab cups sometimes swell out when passing through such cementers, and this can cause tearing of the cups or undesired opening of the cementer. On some other tools, slips may open when passing through the cementer which can cause the tools to stick and can also result in undesired opening or closing of the cementer.

Another factor is that the FO Cementer and the positioning tool therefor are relatively long and machining of the components is somewhat complicated. Reduction in costs is desirable in many instances.

Accordingly, there is a need for a smaller cementer which requires less machining of components and one which is less susceptible to inadvertent opening when some tools are passing therethrough. The present invention meets this need by providing a cementer which is opened by rotation of a positioning tool rather than by reciprocation.

A previously known cementer which uses rotation for opening and closing is the TAM port collar manufactured by TAM International, Inc. In this device, a tool is run in on a work string to operate the port collar. The tool has spring-loaded dogs to latch into an inner sleeve in the port collar, allowing the collar to be opened and closed with rotation. The inner sleeve in the TAM port collar has an inside diameter less than that of the casing string so that when the operating tool is run into the casing, an indication is given to the operator at the surface when the latching dogs engage this smaller inside diameter so that the operator will know that the tool is positioned. Having a smaller diameter in the cementer is undesirable in many cases, so there is a need for a cementer opened by rotation which has a large diameter. The present invention solves this problem by providing a cementer with a valve sleeve which has an inside diameter no less than that of the casing string.

With the operating tool in the TAM port collar, there is no means for limiting torque. Therefore, excessive torque may be applied to the port collar inner sleeve, which may cause damage to the operating tool and/or the port collar. Therefore, there is a need for a casing cementer opened by rotation wherein the operating tool has a means for limiting torque. The present invention provides such a solution to this problem.

SUMMARY OF THE INVENTION

The present invention comprises a cementer adapted for positioning in a casing string and further comprises a torque-limiting positioning tool for opening and closing the cementer.

The casing cementer comprises a housing defining a central opening therein and having a housing port therethrough for providing communication between the central opening and a well annulus, and a valve sleeve rotatably disposed in the central opening of the housing and defining a valve port therein. The valve port is aligned with the housing port when the valve is rotated to an open position, and the valve port is unaligned with respect to the housing port when the valve is rotated to a closed position.

The apparatus also preferably comprises sealing means for sealing around the valve port between the valve and housing. At least a portion of this sealing means may be characterized by an annular seal disposed in an annular groove defined in the valve sleeve around the valve port. The annular seal is preferably molded or bonded to the valve sleeve.

The apparatus further also comprises stop means for limiting rotation of the valve sleeve between the open and closed positions. The stop means may comprise a circumferential slot defined in one of the valve and housing, and a stop extending from the other of the valve and the housing and extending into the slot. Opposite ends of the slot engage the stop when the valve is in the open and closed positions thereof.

The valve sleeve may also define a longitudinally extending slot therein. The slot is adapted for engagement by a portion of the positioning tool whereby the sleeve may be rotated between the open and closed positions.

The valve sleeve preferably has an inside diameter at least as large as an inside diameter of the casing string. Above the valve sleeve, the housing defines an annular recess therein. When the positioning tool passes by this recess, a weight indication is given at the surface to the operator as will be further described herein.

The positioning tool comprises a mandrel portion, a drag block body at the lower end of the mandrel portion, and a drag block disposed in the drag block body and biased radially outwardly with respect thereto for engagement with the valve sleeve in the cementer. The drag block engages the inside diameter of the casing as the positioning tool is moved downwardly therethrough. When the drive block enters the above-described recess in the cementer housing, it will snap outwardly and then be compressed radially inwardly again as the positioning tool moves further downwardly, thereby providing a weight indication to the operator at the surface.

In the embodiment described, the drag block engages the slot in the valve sleeve, so that the valve sleeve may be moved between open and closed positions thereof by rotation of the mandrel portion of the positioning tool.

In the preferred embodiment, the mandrel portion is a lower mandrel portion, and the positioning tool further comprises an upper mandrel portion and clutch means engaging the upper and lower mandrel portions. The clutch means provides for slip between the upper and lower mandrel portions when a relative torque applied therebetween exceeds a predetermined amount. The clutch means comprises a first clutch ring connected to the upper mandrel portion and rotatable therewith and a second clutch ring disposed adjacent to the first clutch ring. The first and second clutch rings comprise a plurality of teeth spaced therearound. The teeth on the second clutch ring normally engage the teeth on the first clutch ring. The teeth slip relative to one another when the torque exceeds the predetermined value. The teeth comprise crests and roots which taper inwardly toward one another in the direction of a central axis of the clutch rings.

The positioning tool further comprises a housing attached to the lower mandrel portion and extending upwardly therefrom. The housing defines a longitudinal housing groove therein. The upper mandrel portion is at least partially disposed within the housing and defines a longitudinal mandrel groove thereon. The first clutch ring comprises a key portion extending into the mandrel groove, and the second clutch ring comprises a key portion extending into the housing groove. A flange extends from the upper mandrel portion.

The apparatus further comprises biasing means for biasing the first clutch ring toward the second clutch ring. The biasing means may be characterized by a spring disposed in the housing between the flange on the upper mandrel portion and the first clutch ring. An adjusting means, such as an adjustment nut, may be provided for adjusting a preload on the spring. A locking means may be used to lock the nut with respect to the upper mandrel portion.

In one embodiment, the drag block body on the lower mandrel portion on the positioning tool is a lower drag block body, and the tool further comprises a second drag block body rotatably disposed on the lower mandrel portion. When the drag blocks on the upper drag block body enter the previously described recess in the cementer housing, the second drag blocks will snap radially outwardly. Further downward movement will tend to compress the second drag blocks, thereby providing another weight indication at the surface. The number of drag blocks on the upper drag block body is preferably greater than the number of drag blocks on the lower drag block body so that a greater force is required for engagement of the upper drag block body with the cementer than for the lower drag block body with the cementer. This greater second weight indication tells the operator that the second drag blocks have engaged the cementer and the positioning tool is in its operating position.

An important object of the invention is to provide a casing cementer for use in a well bore which may be opened and closed by rotation rather than reciprocation of a positioning tool.

An additional object of the invention is to provide a casing cementer with a positioning tool which latches in place for opening and closing the cementer.

A further object of the invention is to provide a cementing tool opened by rotation and having torque limiting means for preventing damage to the tool.

Additional objects and advantages of the invention will become apparent as the following detailed description of the preferred embodiment is read in conjunction with the drawings which illustrate such embodiment.

DESCRIPTION OF THE PREFERRED EMBODIMENT

Figure 1:
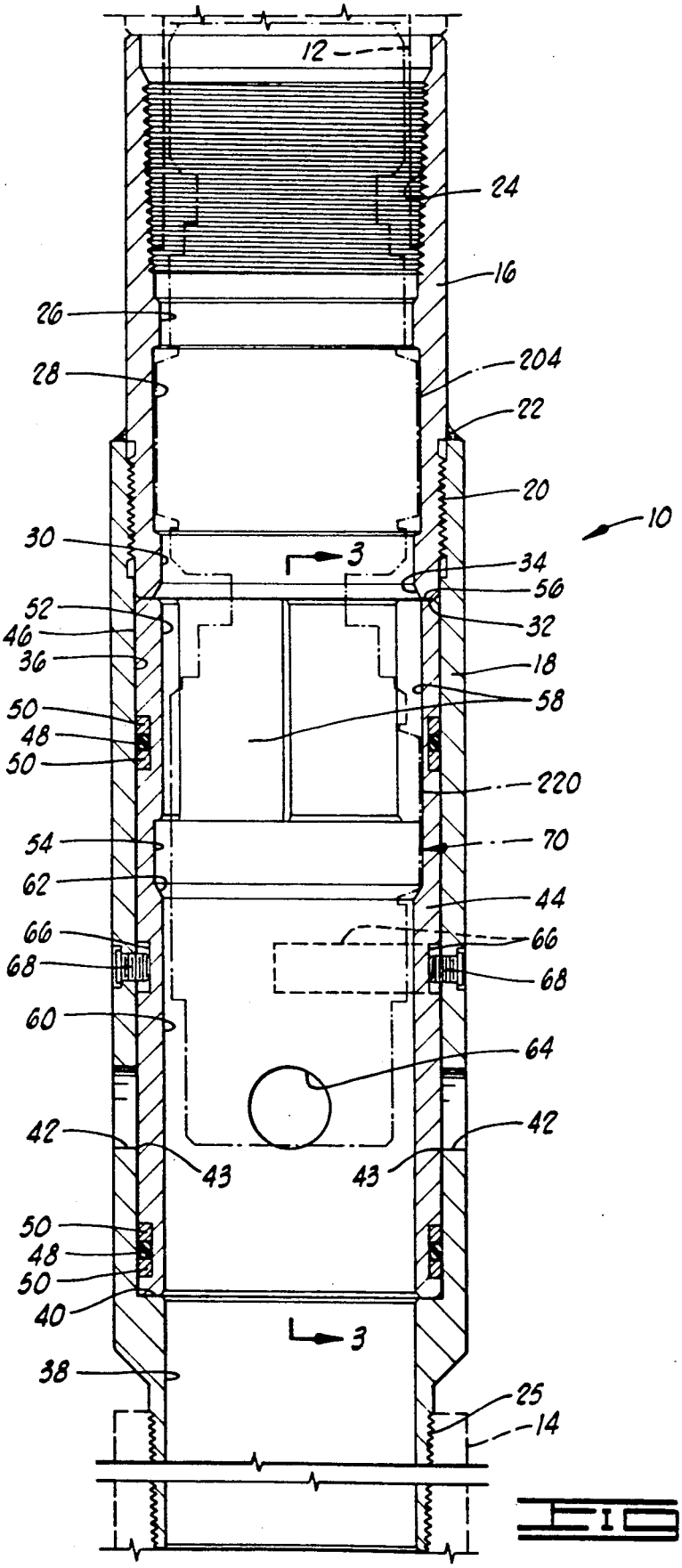
FIG. 1 is a longitudinal cross section of the casing cementer of the present invention.

Referring now to the drawings, and more particularly to FIG. 1, the casing cementer of the present invention is shown and generally designated by the numeral 10. Cementer 10 is adapted to be a component in the casing and is therefore attached at its upper end to an upper casing string portion 12 and at its lower end to a lower casing string portion 14.

Cementer 10 comprises a housing formed by an upper body attached to a case 18 at threaded connection 20. Upper body 16 is preferably permanently affixed to case 18 by a fastening means such as a weld 22.

Upper body 16 also has an internally threaded surface 24 which is adapted for engagement with a threaded end of upper casing string portion 12. Case 18 has an externally threaded surface 25 which is adapted for engagement with a threaded opening in lower casing string portion 14.

Upper body 16 has a first bore 26, a larger second bore 28 and a third bore 30 which is smaller than second bore 28. Thus, second bore 28 may also be described as a recess 28 between first bore 26 and third bore 30.

Upper body 16 has a lower end 32 with a downwardly facing inner chamfer 34 adjacent thereto.

Case 18 defines a first bore 36 and a smaller second bore 38 therein. An upwardly facing shoulder 40 ex[illegible] between first bore 36 and second bore 38. It will be seen that shoulder 40 generally faces lower end 32 of upper body 16.

A plurality of case or housing ports 42 are defined transversely through case 18 and are in communication with first bore 36. While a pair of case ports 42 are shown in the embodiment illustrated, the invention is not intended to be limited to any particular number.

Rotatably disposed in case 18 between lower end 32 of upper body 16 and shoulder 40 is a valve sleeve 44. Valve sleeve 44 has an outside diameter 46 adapted for fitting closely within first bore 36 in case 18. A sealing means, such as 0-rings 48 supported by backup rings 50, provides sealing engagement between valve sleeve 44 and first bore 36 in case 18 on opposite sides of case ports 42, even when valve sleeve 44 is rotated.

Valve sleeve 44 has a first bore 52 and a slightly larger second bore 54 therein. Between upper end 56 of valve sleeve and second bore 54, a plurality of generally longitudinal slots 58 are formed in first bore 52 in valve sleeve 44.

Below second bore 54 in valve sleeve 44 is a third bore 60. Third bore 60 is smaller than first bore 52. A generally upwardly facing chamfer 62 extends between second bore 54 and third bore 60.

Valve sleeve 44 defines a plurality of substantially transverse valve ports 64 therethrough. The exact number is not critical to the invention, but there should be the same number of valve ports 64 in valve sleeve 44 as there are case ports 42 in case 18. Thus, in the embodiment shown, there are two valve ports 64, and in the closed position illustrated in FIG. 1, valve ports 64 are positioned approximately 90° from case ports 42. The inner edge 43 of each case port 42 is radiused.

Figure 2A:
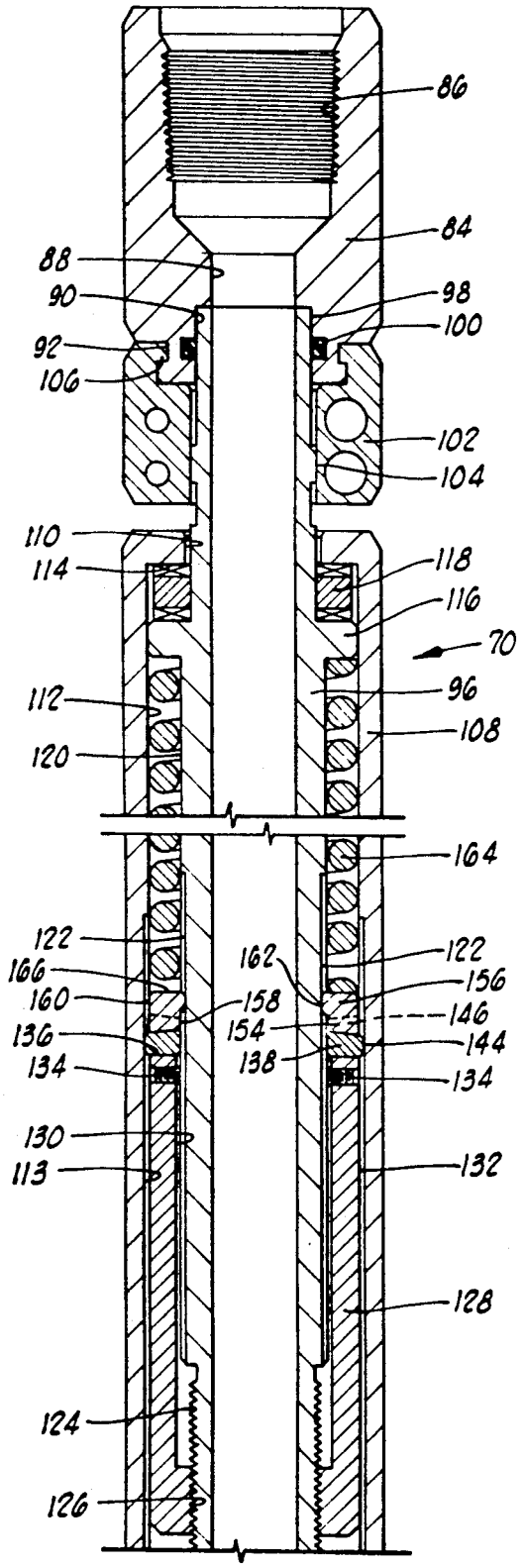
FIGS. 2A and 2B show a longitudinal cross section of the positioning tool for opening and closing the cementer.
Figure 2B:
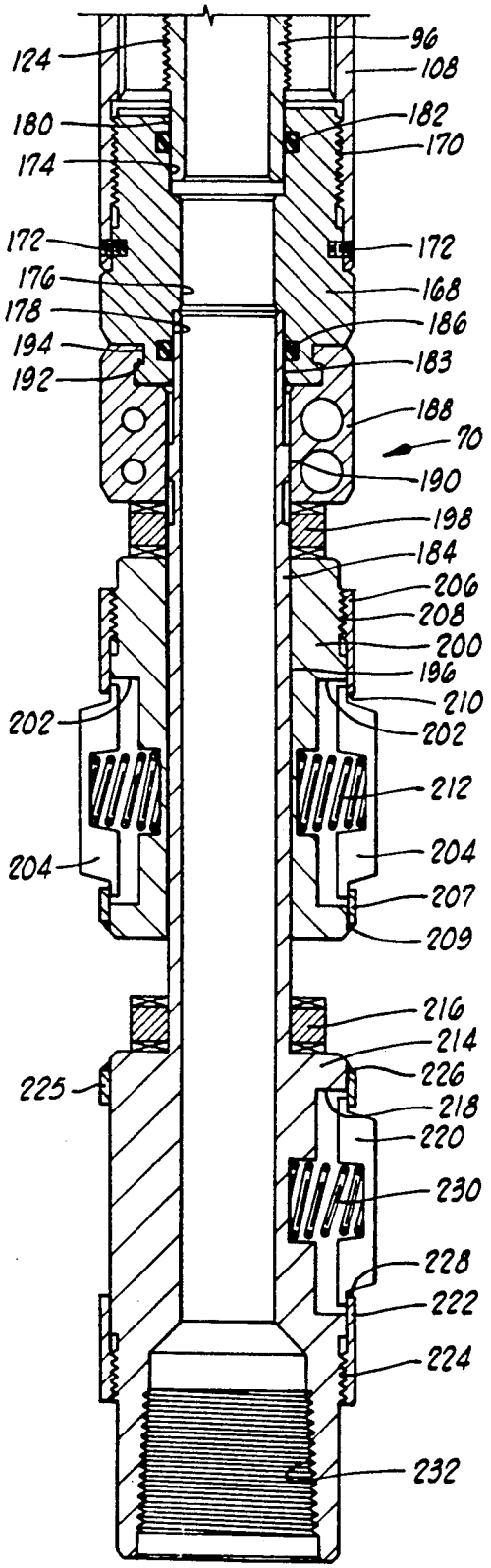

Valve sleeve 44 defines a pair of generally circumferential slots 66 which are recessed in outside diameter 46 thereof. Slots 66 are circumferentially spaced from one another at approximately 180°. A pair of stops 68 are threadingly engaged with case 18. Each stop 68 extends radially inwardly into a corresponding slot 66. Slots 66 extend circumferentially around valve sleeve 44 slightly more than 90° each, so it will be seen by those skilled in the art that the interaction of stops 68 with the corresponding slots 66 limits rotation of valve sleeve 44 within case 18 to approximately 90° in one direction and approximately 90° back in the other direction. In the preferred embodiment, valve sleeve 44 may be rotated 90° clockwise when viewed from the top, after which it can be rotated back 90° counterclockwise. As will be further discussed herein, rotation of valve sleeve 44 within case 18 is accomplished by use of a positioning tool 70, the details of which are shown in FIGS. 2A and 2B.

Figure 3:
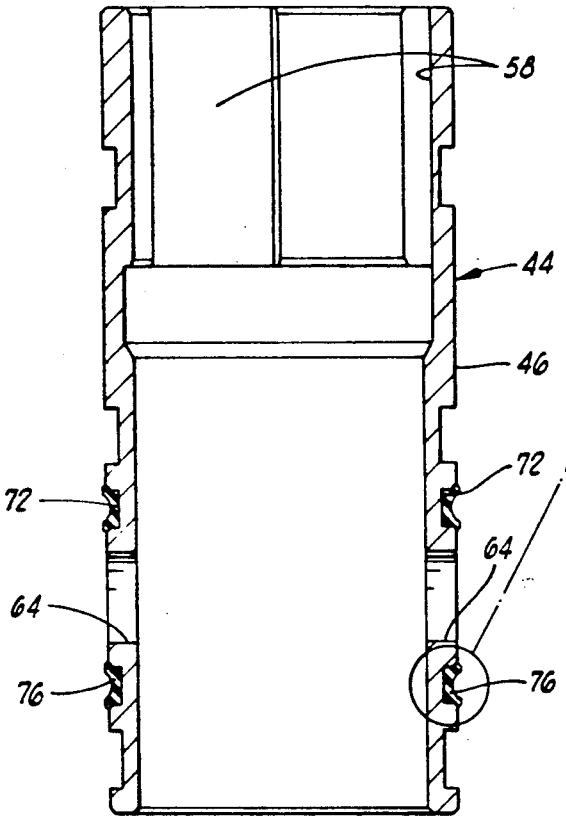
FIG. 3 is a cross section of a valve sleeve in the taken along lines 3—3 in FIG. 1.
Figure 3A:
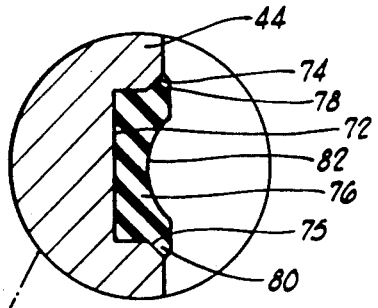
FIG. 3A is an enlarged portion of FIG. 3 showing additional detail of the valve seal.
Figure 4:
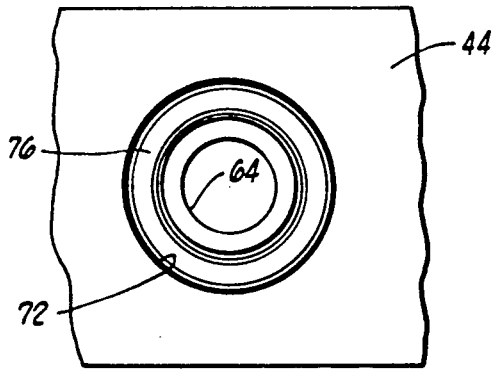
FIG. 4 is an elevation of the valve seal as viewed from the right of FIG. 3.

Referring now to FIGS. 3, 3A and 4, additional details of valve sleeve 44 will be discussed. An annular seal groove is formed in outside diameter 46 of valve sleeve 44 around each valve port 64. As best seen in FIG. 3A, at the inner edge of each groove 72 is an inner chamfer 74 and at the outer edge an outer chamfer 75.

An elastomeric port seal 76 is disposed in each groove 72. Each port seal 76 has an inner lip 78 adjacent to chamfer 74 and an outer lip 80 adjacent to chamfer 75. An outwardly facing annular, curvilinear groove 82 is defined between inner lip 78 and outer lip 80. Radiused edge 43 of case ports 42 prevent cutting of port seal 76.

In the preferred embodiment, port seals 76 are bonded in groove 72 so that they essentially become an integral part of valve sleeve 44.

Referring now to FIGS. 2A and 2B, the details of positioning tool 70 will be discussed. As seen in FIG. 2A, at the upper end of positioning tool 70 is an upper adapter 84 having a threaded surface 86 therein which is adapted for connection to a tool or drill pipe string (not shown) of a kind known in the art. Upper adapter 84 has a first bore 88 and a larger second bore 90 defined therein. An annular groove 92 is formed in the outer surface of upper adapter 84.

An upper mandrel portion in the form of a spring mandrel 96 has a first outer surface 98 which fits closely within second bore 90 in upper adapter 84. A sealing means, such as O-ring 100, provides sealing engagement between upper adapter 84 and spring mandrel 96. A split ring 102 clampingly engages the lower end of upper adapter 84 and raised second outer surface 104 on spring mandrel 96, thereby preventing relative rotation between upper adapter 84 and spring mandrel 96. Split ring 102 has an inwardly directed flange 106 which engages groove 94 in upper adapter 84 so that longitudinal movement therebetween is prevented.

The lower portion of spring mandrel 96 is disposed within a spring housing 108 having a first bore 110 and a larger second bore 112 defined therein. A pair of longitudinal housing grooves 113 are defined in at least a lower portion of second bore 112. A downwardly facing shoulder 114 extends between first bore 110 and second bore 112.

Extending radially outwardly on spring mandrel 96 is a flange 116 which fits closely within second bore 112 of spring housing 108. A thrust bearing assembly 118 is disposed between flange 116 and shoulder 114.

Below flange 116, spring mandrel 96 has a third outer surface 120 with a pair of longitudinal mandrel grooves 122 defined in at least a lower portion thereof. Below third outer surface 120 spring mandrel 96 has a threaded outer surface 124.

Threaded outer surface 124 is engaged by a threaded inner surface 126 in the lower end of an elongated adjustment nut 128. Nut 128 has a bore 130 therein which is spaced outwardly from second outer surface 120 of spring mandrel 96. Nut 28 also has an outer surface 132 which is sized for slidingly fitting within second bore 112 in spring housing 108. As will be further discussed herein, nut 128 may be locked into position with respect to spring mandrel 96 by a locking means, such as one or more set screws 134 which engage third outer surface 120 of the spring mandrel.

Figure 5:
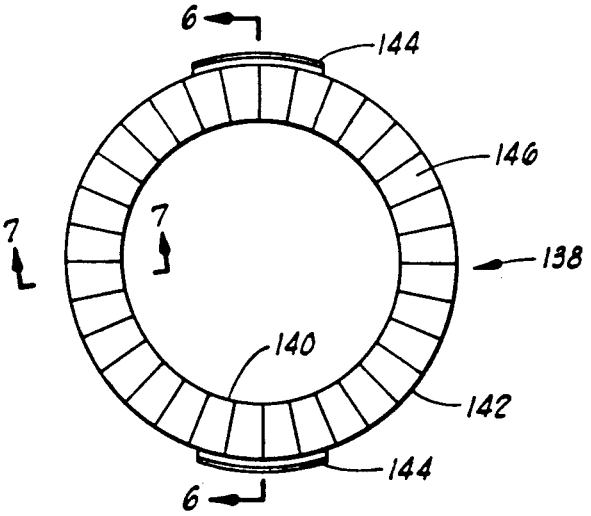
FIG. 5 is a plan view of a clutch ring in the positioning tool.
Figure 6:
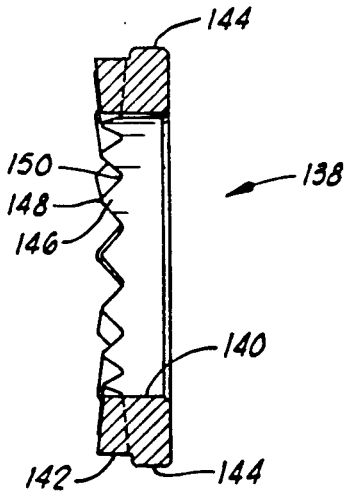
FIG. 6 is a cross section taken along lines 6—6 in FIG. 5.
Figure 7:
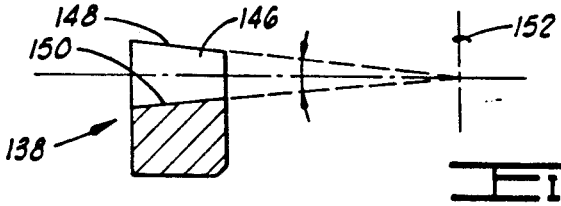
FIG. 7 is a partial cross section taken along lines 7—7 in FIG. 5.

Adjusting nut 128 has an upper end 136 against which is positioned a lower clutch ring 138. Referring now also to FIGS. 5-7, lower clutch ring 138 has a bore 140 therein and an outer surface 142. Extending radially outwardly from outer surface 142 are a pair of key portions 144. As seen in FIG. 2A, key portions 144 extend into housing grooves 113 in second bore 112 in spring housing 108. Thus, it will be seen that rotation of lower clutch ring 138 within spring housing 108 is prevented while still allowing longitudinal movement of the lower clutch ring within the spring housing.

On the upper side of lower clutch ring 138 are a plurality of teeth which are spaced substantially evenly around the ring. Teeth 146 form a plurality of alternating crests 148 and roots 150. As best seen in FIG. 7, crests 148 and roots 150 taper inwardly toward one another with respect to the central axis 152 of lower clutch ring 138.

Turning again to FIG. 2A, teeth 146 on lower clutch ring 138 are engaged by substantially identical, but downwardly facing teeth 154 on an upper clutch ring 156. Upper clutch ring 156 has a bore 158 therein and an outer surface 160. Extending radially inwardly from bore 158 are a pair of key portions 162. Key portions 162 extend into corresponding mandrel grooves 122 on spring mandrel 96. Thus, it will be seen that rotation of upper clutch ring 156 with respect to spring mandrel 96 is prevented while longitudinal movement therebetween is still allowed.

A biasing means, such as a spring 164, is disposed between flange 116 on spring mandrel 96 and upper end 166 of upper clutch ring 156. Thus, upper clutch ring 156 is biased toward, and into engagement with, lower clutch ring 138. Also, both spring 164 thus forces lower clutch ring 138 against upper end 136 of adjustment nut 128.

Referring now to FIG. 2B, the lower end of spring housing 108 is attached to a swivel connector 168 at threaded connection 170. One or more set screws 172 prevent disengagement of threaded connection 170.

Swivel connector 168 defines a first bore 174, a smaller second bore 176 and a third bore 178 therein.

A fourth outside diameter 180 of spring mandrel 96 fits within first bore 174 of swivel connector 168. A sealing means, such as O-ring 182, provides sealing engagement between spring mandrel 96 and swivel connector 168.

A first outside diameter 183 at the upper end of a lower mandrel portion characterized by a drag block mandrel 184 fits closely within third bore 178 in swivel connector 168. A sealing means, such as O-ring 186, provides sealing engagement between drag block mandrel 184 and swivel connector 168.

A split ring 188, substantially similar to split ring 102, clampingly engages the lower end of swivel connector 168 and a second outside diameter 190 on drag block mandrel 184, thus preventing relative rotation between swivel connector 168 and drag block mandrel 184. Split ring 188 has an inwardly directed flange 192 which engages groove 194 in swivel connector 168 so that longitudinal movement therebetween is prevented.

Below split ring 188, drag block mandrel 184 has a third outside diameter 196. An upper thrust bearing 198 is disposed on third outside diameter 186 just below split ring 188.

An upper drag block body 200 is rotatably disposed on third outside diameter 186, and upper thrust bearing 198 is adapted for providing rotatable contact between upper drag block body 200 and split ring 188 when necessary.

Upper drag block body 200 defines a plurality of drag block cavities 202 therein. An upper drag block 204 is disposed in each drag block cavity 202.

An upper drag block retainer 206 is attached to upper drag block body 200 at threaded connection 208. An upper drag block retainer ring 207 is attached to upper drag block body 200 by any means known in the art, such as a weld 209. A portion of each upper drag block 204 extends outwardly through an opening 210 formed by upper drag block retainer 206 and upper drag block retainer ring 207.

A biasing means, such as spring 212, biases each upper drag block 204 radially outwardly.

At the lower end of drag block mandrel 184 is a lower drag block body 214. Lower drag block body 214 is shown in FIG. 2B to be integrally formed with drag block mandrel 184. This may be accomplished by machining drag block mandrel 184 and lower drag block body 214 from a single piece of material, casting the mandrel and lower drag block body together, or fixedly attaching the mandrel and drag block body as by welding, or any other means known in the art. Whether drag block mandrel 184 and lower drag block body 214 are integrally formed, or whether they are rigidly attached to one another is not critical, so long as they rotate together.

Immediately above lower drag block body 214 is a lower thrust bearing 216 which is disposed on third outside diameter 196 of drag block mandrel 184. Lower thrust bearing 216 is adapted for providing rotating contact between upper drag block body 200 and lower drag block body 214 as necessary when upper drag block body 200 is moved downwardly along drag block mandrel 184 to engage the lower thrust bearing.

Lower drag block body 214 defines a plurality of drag block cavities 218 therein. A lower drag block 220 is disposed in each drag block cavity 218.

A lower end of a lower drag block retainer 222 is attached to lower drag block body 214 at threaded connection 224. A lower drag block retainer ring 225 is attached to lower drag block body 214 by any means known in the art, such as by a weld 226.

A portion of each lower drag block 220 extends through an opening 228 formed by lower drag block retainer 222 and lower drag block retainer ring 225.

A biasing means, such as a spring 230, biases each lower drag block 220 radially outwardly.

In one preferred embodiment, four upper drag blocks 204 are used in upper drag block body 200 and three lower drag blocks 220 are used in lower drag block body 214. In this way, the force required to insert lower drag block body 214 into cementer 10 will be less than that required to insert upper drag block body 200 into the cementer, as will be further described herein. However, it should be understood that the invention is not intended to be limited to any particular number of drag blocks 204 or 220, although it is preferred that the force required to insert lower drag block body 214 be less than that for upper drag block body 200.

At the lower end of drag block body 214 is a threaded opening 232 which is in communication with the central opening through positioning tool 70.

OPERATION OF THE INVENTION

Cementer 10 is placed in a well casing string at a predetermined position and run to the preselected point in the well bore. Normally, at the lower end of the casing string there is a shoe joint, and the first stage of cement is placed down through the shoe joint and into the well annulus behind the casing. A cementing plug follows the first stage cement and serves to hold the casing pressure from above while cementing the upper stage through cementer 10.

When it is desired to cement through cementer 10, a drill pipe string with positioning tool 70 thereon is run into the casing string. When lower drag blocks 204 are in upper casing portion 12, they are deflected radially inwardly by contact with the inside diameter of the casing. First bore 26 in upper body 16 is substantially the same size as the casing inside diameter. Lower drag blocks 220 will snap outwardly when they enter recess 28 in upper body 16, and then will be compressed radially inwardly again by contact with third bore 30 in upper body 16. The operator is aware of this by a weight indication at the surface.

When upper drag blocks 204 are in upper casing portion 12, they are similarly deflected inwardly and then snap outwardly into recess 28 in upper body 16 of cementer 10. This gives the operator a greater weight indication at the surface because more force is required to compress the four upper drag blocks 204 than the three lower drag blocks 220, as previously mentioned.

When positioning tool 70 is properly positioned within cementer 10 as seen in FIG. 1, upper drag blocks 204 are in recess 28 in upper body 16, and lower drag blocks 220 are in first bore 52 of valve sleeve 44.

If lower drag blocks 220 are aligned with slots 58, they will be forced radially outwardly into the slots by springs 230. If lower drag blocks 220 are not aligned with slots 58, rotation of the drill string and positioning tool 70 will bring lower drag blocks 220 into alignment with slots 58 so that they will snap outwardly into the slots. This is made possible because lower drag block body 214 rotates with drag block mandrel 184, and drag block mandrel 184 is free to rotate within upper drag block body 200, as previously described. In other words, upper drag block body 200 and upper drag blocks 204 do not rotate.

By applying left-hand rotation to the drill string, lower drag block body 214 rotates within cementer 10.

The engagement of lower drag blocks 220 with slots 58 will thus be seen to rotate valve sleeve 44 clockwise (as viewed from the top) within case 18 of cementer 10. Valve sleeve 44 may be rotated in this manner until the ends of slots 66 come in contact with stops 68 which prevent further rotation of the valve sleeve. Thus, valve ports 64 in valve sleeve 44 are aligned with case ports 42 in case 18, so that valve sleeve 44 is in its open position.

At this point, further rotation of the drill string results in rotation of spring mandrel 96 and upper clutch ring 156 with respect to lower clutch ring 13 and adjustment nut 128. When sufficient torque is applied, teeth 154 on upper clutch ring 156 start to slip with respect to teeth 146 on lower clutch ring 138. It will be seen by those skilled in the art that this forces upper clutch ring 156 longitudinally upwardly with respect to lower clutch ring 138, thereby compressing spring 164 slightly. When the crests of teeth 154 on upper clutch ring 156 pass by crests 148 of the corresponding teeth 146 on lower clutch ring 138, spring 164 will be seen to move lower clutch ring 138 back downwardly. As torque is applied to the drill string, this results in a ratcheting action which is easily detectable at the surface, so the operator knows when valve sleeve 44 in cementer 10 has been opened and when no more rotation of the drill pipe string is required.

As already noted, when valve sleeve 44 is in the open position, valve ports 64 therein are aligned with corresponding case ports 42. Cement may then be flowed down the drill string through positioning tool 70 and through the aligned ports 64 and 42 into the well annulus outside cementer 10. The actual pumping of cement is carried out in a manner known in the art.

After cementing, right-hand rotation on the drill string will cause lower drag blocks 220 on positioning tool 70 to rotate valve sleeve 44 back to the closed position. The other end of slots 66 engage stops 68 after rotation of about 90°. If further torque is applied to the drill string, the ratcheting of upper clutch ring 156 with lower clutch ring 138 occurs in the opposite direction, and the operator knows to stop applying torque because valve sleeve 44 is closed.

By using this same technique, cementer 10 may be reopened for testing, squeeze cementing or retesting of the primary cement job.

It will be seen, therefore, that the casing cementer with torque-limiting rotating positioning tool of the present invention is well adapted to carry out the ends and advantages mentioned, as well as those inherent therein. While a preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. A casing cementer apparatus for use in a casing string in a well bore, said apparatus comprising:

a housing defining a central opening therein and having a housing port therethrough for providing communication between said central opening and a well annulus;

a valve sleeve rotatably disposed in said central opening and defining a valve port therein, wherein said valve port is aligned with said housing port when said valve sleeve is rotated to an open position and said valve port is unaligned with respect to said housing port when said valve sleeve is rotated to a closed position; and sealing means bonded to said valve sleeve for sealing around said valve port between said valve sleeve and said housing.

2. The apparatus of claim 1 further comprising stop means for limiting rotation of said valve sleeve between said open and closed positions.

3. The apparatus of claim 2 wherein said stop means comprises:

a circumferential slot defined in one of said valve sleeve and said housing; and a stop extending from the other of said valve sleeve and said housing and extending into said slot, whereby opposite ends of said slot engage said stop when said valve sleeve is in said opened and closed positions.

4. The apparatus of wherein said sealing means comprises:

said valve sleeve defining an annular groove on an outer surface thereof adjacent to said valve port; and an annular seal disposed in said groove and bonded thereto.

5. The apparatus of claim 4 wherein said annular seal comprises:

an inner lip; and an outer lip;

wherein, said seal defines an outwardly facing annular, curvilinear groove between said inner and outer lips.

6. The apparatus of claim 1 wherein said valve sleeve has an inside diameter at least as large as the casing string.

7. A positioning tool for use in a cementer having a rotatable valve therein, said tool comprising:

a mandrel portion;

a drag block body at the lower end of said mandrel portion; and a drag block disposed in said drag block body and biased radially outwardly with respect thereto for engagement with the rotatable valve in the cementer, whereby the valve may be moved between open and closed positions thereof by rotation of said mandrel portion.

8. The tool of claim 7 wherein said mandrel portion is a lower mandrel portion, and further comprising:

an upper mandrel portion; and clutch means engaging said upper and lower mandrel portions and providing for slip between said upper and lower mandrel portions when a relative torque applied therebetween exceeds a predetermined value.

9. The tool of claim 8 wherein said clutch means comprises:

a first clutch ring connected to said upper mandrel portion and rotatable therewith, said first clutch portion comprising a plurality of teeth spaced therearound;

a second clutch ring disposed adjacent to said first clutch ring, said second clutch ring comprising a plurality of teeth spaced therearound and normally engaging said teeth on said first clutch ring, whereby said teeth slip relative to one another when said torque exceeds said predetermined value.

10. The apparatus of claim 9 further comprising biasing means for biasing said first clutch ring toward said second clutch ring.

11. The tool of claim 9 wherein said teeth comprise crests and roots which taper inwardly toward one another with respect to a central axis of said first and second clutch rings.

12. The tool of claim 9 further comprising a housing attached to said lower mandrel portion and extending upwardly therefrom, said housing defining a longitudinal housing groove therein, and wherein:

said upper mandrel portion is at least partially disposed within said housing and defines a longitudinal mandrel groove thereon;

said first clutch ring comprises a key portion extending into said mandrel groove; and said second clutch ring comprises a key portion extending into said housing groove.

13. The tool of claim 12 further comprising:

a flange extending from said upper mandrel portion; and a spring disposed in said housing between said flange and said first clutch ring, whereby said first clutch ring is biased toward said second clutch ring.

14. The tool of claim 13 further comprising adjusting means for adjusting a preload on said spring.

15. A cementing tool for use in cementing a casing in a well bore, said tool comprising:

a cementer disposed in said casing string, said cementer comprising:

a case defining a case port therein; and a valve sleeve rotatably disposed in said case and defining a valve port therein alignable with said case port when said valve sleeve is in an open position, said valve sleeve having an inside diameter at least as large as an inside diameter of the casing, and said valve sleeve further defining a longitudinal slot therein; and a positioning tool comprising:

an upper mandrel portion connectable to a drill string;

a lower mandrel portion rotatable with said upper mandrel portion; and a drag block extending from said lower mandrel portion and adapted for engagement with said slot in said valve sleeve.

16. The tool of claim 15 wherein said cementer further comprises a stop for limiting rotation of said valve sleeve between said open position and a closed position thereof.

17. The tool of claim 16 wherein said positioning tool further comprises a clutch providing engagement between said upper mandrel portion and said lower mandrel portion and being adapted for slipping when torque applied thereto exceeds a predetermined amount, thereby providing an indication that said valve sleeve in said cementer has reached one of said open and closed positions thereof.

18. The tool of claim 17 wherein said clutch comprises:

a first clutch ring having a plurality of teeth extending therefrom;

a second clutch ring having a plurality of teeth extending therefrom and adapted for meshing with said teeth in said first clutch ring; and biasing means for biasing said clutch rings together and allowing longitudinal movement therebetween when said teeth on said first clutch ring slip with respect to said teeth on said second clutch ring when said torque exceeds said predetermined amount.

19. The tool of claim 15 wherein said drag block is one of a plurality of first drag blocks; and further comprising a plurality of second drag blocks disposed around said lower mandrel portion and rotatable with respect thereto, said second drag blocks being adapted for engagement with said cementer and requiring a greater force for such engagement than said first drag blocks, thereby providing a weight indication to an operator that said second drag blocks have engaged said cementer.

20. The tool of claim 19 wherein a number of said second drag blocks is greater than a number of said first drag blocks.

* * * * *